US008558439B2

(12) United States Patent
Unger et al.

(10) Patent No.: US 8,558,439 B2
(45) Date of Patent: Oct. 15, 2013

(54) ANTI-FOULING SPARK PLUG AND METHOD OF MAKING

(75) Inventors: Peter Unger, Morristown, NJ (US); Ron Rohrbach, Flemington, NJ (US); Jeff Boehler, Holland, OH (US); Jing Zheng, Findlay, OH (US)

(73) Assignee: Fram Group IP LLC, Lake Forest, IL (US)

( * ) Notice: Subject to any disclaimer, the term of this patent is extended or adjusted under 35 U.S.C. 154(b) by 79 days.

(21) Appl. No.: 13/312,269

(22) Filed: Dec. 6, 2011

(65) Prior Publication Data

US 2012/0169205 A1 Jul. 5, 2012

Related U.S. Application Data

(60) Provisional application No. 61/420,127, filed on Dec. 6, 2010.

(51) Int. Cl.
*H01T 13/02* (2006.01)

(52) U.S. Cl.
USPC ..... 313/118

(58) Field of Classification Search
None
See application file for complete search history.

(56) References Cited

U.S. PATENT DOCUMENTS

| | | | | |
|---|---|---|---|---|
| 4,092,264 | A | 5/1978 | Tsang et al. | |
| 4,267,483 | A | 5/1981 | Nakajima et al. | |
| 4,415,828 | A | 11/1983 | Mizuno et al. | |
| 5,109,178 | A | 4/1992 | Yoshida et al. | |
| 5,274,298 | A | 12/1993 | Cassidy et al. | |
| 5,550,424 | A | 8/1996 | Jennrich et al. | |
| 5,952,769 | A * | 9/1999 | Budaragin | 313/141 |
| 6,051,529 | A | 4/2000 | Brezny | |
| 6,060,821 | A | 5/2000 | Suzuki et al. | |
| 6,090,191 | A | 7/2000 | Atlanova et al. | |
| 6,111,345 | A | 8/2000 | Shibata | |
| 6,548,944 | B1 | 4/2003 | Morita | |
| 6,589,900 | B1 | 7/2003 | Kotze | |
| 6,858,975 | B1 | 2/2005 | Matsutani | |
| 6,888,293 | B2 | 5/2005 | Roessler et al. | |
| 2002/0033659 | A1 | 3/2002 | Nishikawa | |
| 2004/0115142 | A1 * | 6/2004 | Sherwood et al. | 424/59 |

OTHER PUBLICATIONS

International Preliminary Report on Patentability of PCT/US2011/063530 dated Jun. 12, 2013.

* cited by examiner

*Primary Examiner* — Ashok Patel
(74) *Attorney, Agent, or Firm* — Barnes & Thornburg LLP

(57) ABSTRACT

Disclosed herein is a spark plug comprising an insulative sleeve having a central axial bore and an exterior surface and a center electrode extending through the central axial bore of the insulative sleeve. The insulating sleeve is positioned within, and secured to, a metal shell that serves as a mounting platform and interface to an internal combustion engine. The metal sleeve also supports a ground electrode that is positioned in a spaced relationship relative to the center electrode so as to generate a spark gap. The insulating sleeve includes a shaped tip portion that resides in a recessed end portion of the metal shell. A coating is disposed on the exterior surface of the insulative sleeve. The coating comprises a silicone resin, optionally in combination with a filler.

6 Claims, 2 Drawing Sheets

ANTI-FOULING SPARK PLUG AND METHOD OF MAKING

CROSS REFERENCE TO RELATED APPLICATIONS

This application claims the benefit of U.S. Provisional Patent Application No. 61/420,127 filed on Dec. 6, 2010, which is incorporated by reference herein in its entirety.

BACKGROUND

In general, spark plugs include an insulative sleeve having a central axial bore through which a center electrode extends. The insulating sleeve is positioned within, and secured to, a metal shell that serves as a mounting platform and interface to an internal combustion engine. The metal sleeve also supports a ground electrode that is positioned in a particular spaced relationship relative to the center electrode so as to generate a spark gap. The insulating sleeve includes a shaped tip portion that resides in a recessed end portion of the metal shell. The shaped tip portion is configured to protect the electrode from engine heat and products of combustion. The spark plug is typically mounted to an engine cylinder head and selectively activated to ignite a fuel/air mixture in an associated engine cylinder.

Over time, products of combustion or combustion deposits build up around the center electrode and particularly the shaped tip portion. This build up of combustion product inhibits spark formation across the spark gap. A significant build up of combustion products may foul the spark plug and resulting in ignition failure, i.e., the combustion products completely block the spark from forming between the center and ground electrodes. Combustion deposit build up is particularly problematic during cold starts. During cold starts, complete combustion of the air/fuel mixture is seldom achieved which results in an increased generation of electrically conductive combustion deposits. As a result of continuous cold starts, electrically conductive combustion deposits build up resulting in an electrical short circuit between the center electrode and the electrically grounded portion of the spark plug.

Previous attempts to address combustion deposit build up issues have included silicone oil coatings and particulate vanadium oxide deposition on the insulating sleeve. These coatings have failed to adequately address the issue, suffering from inadequate performance at elevated temperature, inadequate endurance, or insufficient reduction of combustion deposit build up.

Accordingly, there is a need for a spark plug which has a decreased susceptibility to electrically conductive combustion deposit build up in the insulative sleeve.

BRIEF DESCRIPTION

Disclosed herein is a spark plug comprising an insulative sleeve having a central axial bore and an exterior surface and a center electrode extending through the central axial bore of the insulative sleeve. The insulating sleeve is positioned within, and secured to, a metal shell that serves as a mounting platform and interface to an internal combustion engine. The metal sleeve also supports a ground electrode that is positioned in a spaced relationship relative to the center electrode so as to generate a spark gap. The insulating sleeve includes a shaped tip portion that resides in a recessed end portion of the metal shell. A coating is disposed on the exterior surface of the insulative sleeve. The coating comprises a silicone resin, optionally in combination with a filler.

Also disclosed herein are methods of making the coated insulative sleeve and a spark plug comprising the coated insulative sleeve.

DETAILED DESCRIPTION

Figure 1:
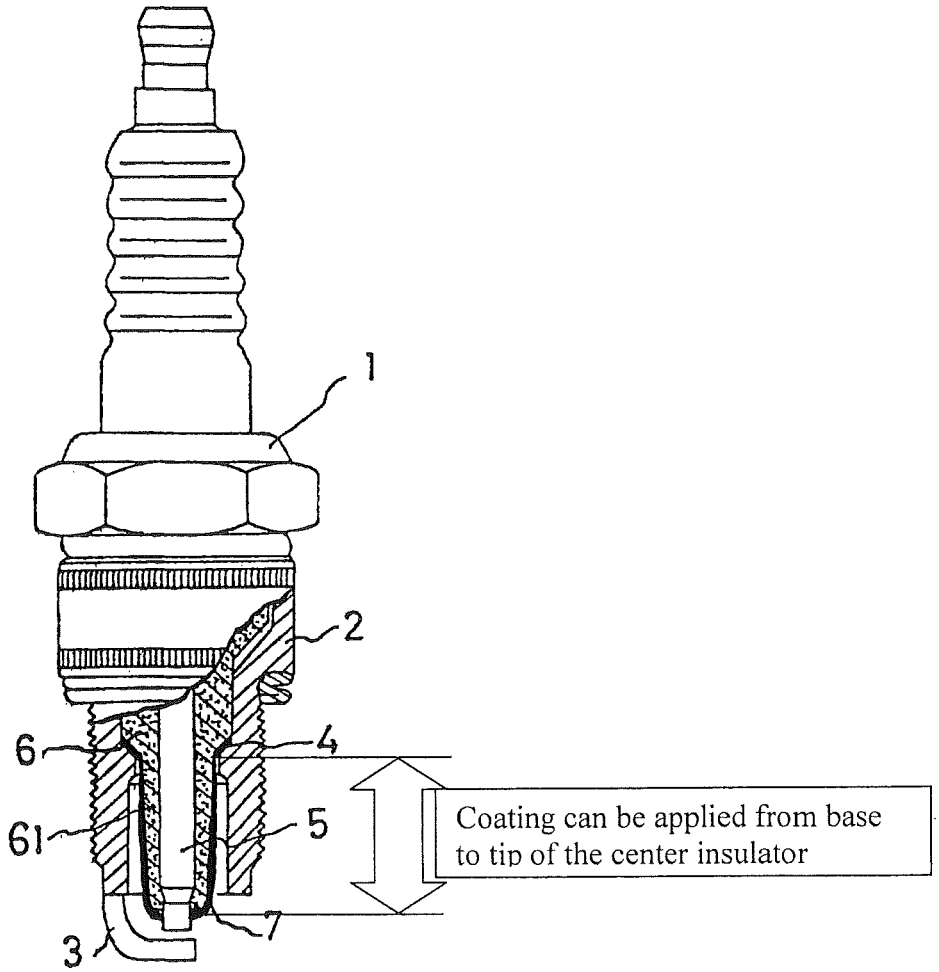
FIG. 1 is a side view of a spark plug, partly shown in cross section.

The coating comprising a silicone resin, as described herein, is a substantially continuous coating. A substantially continuous coating, as defined herein, describes a coating which is has no breaks or gaps visible to the naked eye and covers the exterior surface of the insulative sleeve. The coating thickness can be 1 to 20 micrometers in thickness, or, more specifically 1 to 15 micrometers in thickness.

Silicone resins are highly branched, three dimensional framework polymers that are cross-linked. They can comprise randomly ordered, mainly trifunctional units. Silicone resins can range from being relatively low molecular weight reactive resins to high molecular weight materials with very diverse structures. Silicone resins differ from silicone fluids (oils) in that silicone fluids are linear, non-cross-linked polymers that typically comprise dimethylsiloxane units.

The silicone resin can have a decomposition temperature greater than or equal to 500° C., or, more specifically, greater than or equal to 510° C., or, more specifically, greater than or equal to 525° C.

The silicone resin can be cross-linked (cured) or curable. When the silicone resin is curable it can be cured using ambient moisture or a curing catalyst such as include zinc or stannous octoate, amino-functionalized silane esters, or mixtures thereof.

Exemplary silicone resins include SR355, SR141, Baysilone M 120 XB, and Silblock WA available from Momentive Performance Materials, as well as Dow Corning® 233, Dow Corning® 840, and Dow Corning® 805, available from Dow Corning.

As mentioned above the coating can optionally include an inorganic filler. The filler can be chosen to have a decomposition temperature greater than or equal to 500° C., or, more specifically, greater than or equal to 510° C., or, more specifically, greater than or equal to 525° C. The filler can also be chosen to have an average particle size (as determined by the longest linear dimension) of less than or equal to 13 micrometers. Within this range the average particle size can be 5 nanometers to 10 micrometers. The filler can also be chosen to have to a length to width ratio (aspect ratio) of greater than 1, or, more specifically, greater than or equal to 2, or, more specifically, greater than or equal to 3.

Exemplary fillers include silica, fumed silica, hydrophilic fumed silica, micaceous iron oxide, wollastonite, organoclay, natural clay, alumina, and combinations of the foregoing.

The coating is formed by first forming a dispersion or solution of the silicone resin or silicone resin and filler. Useful carriers for the dispersions include water. Useful solvents for solutions include non-polar aromatic solvents such as toluene, benzene, xylene, and the like. The dispersion or solution can comprise up to 10 weight percent of the silicone resin, based on the total weight of the dispersion or solution. Within this range the amount of silicone resin in the dispersion or solution can be 0.5 to 10 weight percent, or, more specifically, 1 to 5 weight percent. The dispersion or solution can comprise up to 10 weight percent of the inorganic filler, based on the total weight of the dispersion or solution. Within this range the amount of inorganic filler in the dispersion or solution can be 0.5 to 10 weight percent, or, more specifically, 1 to 5 weight percent. The amount of silicone resin and the amount of inorganic filler, on a weight percent basis, can be the same. For example, the dispersion or solution can comprise 2.5 weight percent of silicone resin and 2.5 weight percent inorganic filler, based on the total weight of the slurry or solution.

The dispersion or solution is applied to the insulative sleeve of a spark plug subassembly. A spark plug subassembly comprises an insulative sleeve, center electrode, resistor and terminal stud end. The dispersion or solution can be applied by any appropriate method such as painting, dip coating, spray coating and the like. Any coating applied to the center electrode can be removed by an appropriate method.

The applied dispersion or solution is allowed to air dry, under air flow, at room temperature to for at least 15 minutes, or, more specifically, 1 to 4 hours. Air drying allows for at least partial evaporation of volatile solvents when used and the introduction of moisture when important for cross linking. After air dying the subassembly is then treated at an elevated temperature, such as 100 to 150 degrees C. for 30 minutes to 60 hours, or, more specifically, 1 to 4 hours. The length of time at the elevated temperature should be chosen to be sufficient to form a coating without edge effects, skinning or crack formation. Following the treatment at an elevated temperature, curing the silicone resin is completed at a temperature of 300 to 450° C. for 30 to 90 minutes.

An exemplary spark plug is shown in FIG. 1. The spark plug, 1, has a metal shell, 2, a ground electrode, 3, a center electrode, 5, an insulative sleeve, 6, a shaped tip portion of the insulative sleeve, 61, and a coating, 7, disposed on the insulative sleeve.

The invention is further illustrated by the following non-limiting examples.

Thin films of test materials/coatings were prepared on alumina or glass substrate strips and heated to target temperatures for 15 minutes. The amount of filler relative to the amount of silicone resin is shown in the table. For example, an amount of 0.2X means that the mass of filler was 0.2 times the mass of silicone resin. Therefore, "1X" means that the mass of filler and the mass of silicone resin were the same. The strips were then removed from muffle furnace and allowed to cool to room temperature. A water droplet was placed on coated area and hydrophobicity estimated visually. Slides were then heated to the next highest temperature shown in the table (50° C. increments). Protocol was repeated to max temperature—generally to 600° C. Results are shown in the following tables.

SILICONE RESINS WITH AND WITHOUT FUMED SILICA (0.4-3X)

| | Compound | | | | | | | | | |
|---|---|---|---|---|---|---|---|---|---|---|
| Material | 22 | 200 | 250 | 300 | 350 | 400 | 450 | 500 | 550 | 600 |
| DC 233 (2.5 wt % in xylene) | 90 | 90 | 90 | 90 | 90 | 90 | 90 | 90 | 90 | 0 |
| DC 233 + Fumed Silica (0.2X) | 90 | 90 | 90 | 90 | 90 | 90 | 90 | 90 | 20 | 0 |
| DC 233 + Fumed Silica (1X) | 110 | 110 | 110 | 130 | 130 | 130 | 130 | 130 | 130 | 0 |
| DC 233 + Fumed Silica (2X) | 130 | 130 | 130 | 130 | 130 | 130 | 130 | 130 | 130 | 0 |
| DC 233 + Fumed Silica (3X) | 110 | 100 | 100 | 100 | 100 | 100 | 100 | 100 | 100 | 0 |
| DC 805 (2.5 wt % in xylene) | 90 | 90 | 90 | 90 | 90 | 90 | 90 | 90 | 90 | 0 |
| DC 805 + Fumed Silica (0.2X) | 90 | 100 | 100 | 100 | 100 | 100 | 100 | 100 | 45 | 0 |
| DC 805 + Fumed Silica (1X) | 110 | 100 | 100 | 100 | 100 | 110 | 110 | 110 | 90 | 0 |
| DC 805 + Fumed Silica (2X) | 130 | 130 | 130 | 130 | 130 | 130 | 130 | 130 | 90 | 0 |
| DC 805 + Fumed Silica (3X) | 130 | 130 | 130 | 130 | 130 | 130 | 130 | 130 | 0 | 0 |
| DC 840 (2.5 wt % in xylene) | 90 | 90 | 90 | 90 | 90 | 90 | 90 | 90 | 10 | 0 |
| DC 840 + Fumed Silica (0.2X) | 90 | 90 | 90 | 90 | 90 | 90 | 90 | 90 | 90 | 0 |
| DC 840 + Fumed Silica (1X) | 130 | 130 | 130 | 130 | 130 | 130 | 130 | 130 | 90 | 0 |
| DC 840 + Fumed Silica (2X) | 130 | 130 | 130 | 130 | 130 | 130 | 130 | 130 | 90 | 0 |
| DC 840 + Fumed Silica (3X) | 130 | 130 | 130 | 130 | 130 | 130 | 130 | 130 | 0 | 0 |
| SR141 (2.5 wt % in xylene) | 90 | 90 | 90 | 90 | 90 | 90 | 90 | 90 | 90 | 0 |
| SR141 + Fumed Silica (0.2X) | 90 | 100 | 100 | 100 | 100 | 100 | 100 | 100 | 100 | 0 |
| SR141 + Fumed Silica (1X) | 130 | 130 | 130 | 130 | 130 | 130 | 130 | 130 | 130 | 0 |
| SR141 + Fumed Silica (2X) | 130 | 130 | 130 | 130 | 130 | 130 | 130 | 130 | 130 | 0 |
| SR141 + Fumed Silica (3X) | 130 | 130 | 130 | 130 | 130 | 130 | 130 | 130 | 130 | 0 |

-continued

SILICONE RESINS WITH AND WITHOUT FUMED SILICA (0.4-3X)

| | Compound | | | | | | | | | |
|---|---|---|---|---|---|---|---|---|---|---|
| Material | 22 | 200 | 250 | 300 | 350 | 400 | 450 | 500 | 550 | 600 |
| SR355 (2.5 wt % in xylene) | 90 | 90 | 90 | 90 | 90 | 90 | 90 | 90 | 90 | 0 |
| SR355 + Fumed Silica (0.2X) | 90 | 90 | 90 | 90 | 100 | 100 | 100 | 100 | 90 | 0 |
| SR355 + Fumed Silica (1X) | 110 | 110 | 110 | 110 | 110 | 130 | 130 | 130 | 130 | 110 |
| SR355 + Fumed Silica (2X) | 130 | 130 | 130 | 130 | 130 | 130 | 130 | 130 | 130 | 130 |
| SR355 + Fumed Silica (3X) | 130 | 130 | 130 | 130 | 130 | 130 | 130 | 130 | 130 | 130 |

The inclusion of the inorganic filler (fumed silica) resulted in a coating having an increased water contact angle in contrast to the coating made with the same silicone resin without an inorganic filler. The contact angle is indicative of the hydrophobicity of the coating. A higher water contact angle means greater hydrophobicity. Higher hydrophobicity is believed to interfere with the formation of conductive combustion products due to the role that moisture plays in this process.

Silicone Resin without Inorganic Filler

SR141 silicone resin coating was supplied as a 40-60% solids by weight solution in toluene. The stock solution was diluted with toluene to yield a working coating solution containing 2.5% solid by weight, based on the total weight of the solution.

The tip of spark plug subassembly which will be exposed to the combustion chamber was dip coated in the silicone resin solution as follows:

1. The portion of the insulator requiring the silicone resin treatment was submerged in the diluted silicone resin solution
2. After the tip became thoroughly wetted with the solution, it was drawn upward out of the solution at a medium rate (−1 second)
3. The wetted tips were then allowed to dry under airflow [face velocity ca. 100 feet per minute (FPM)] at room temperature for 1 to 4 hours.
4. The air dried tips were then heated in a convection oven at 120° C. for 1 to 4 hours.
5. The coated tips were then heated in a furnace to a temperature of 350° C. for a period of one hour.
6. The coated subassembly was then used to construct a completed spark plug.

Silicone Resin with Inorganic Filler

The use of some inorganic fillers was found to make the coating more thermal resistant (could be exposed to higher temperatures) and also to augment the native hydrophobicity of the silicone resin.

SR141 silicone resin coating was supplied as a 40-60% solids by weight solution in toluene. The stock solution was diluted with toluene to yield a working coating solution containing 2.5% solid by weight, based on the total weight of the solution.

Fumed silica was obtained from Sigma Chemical in the form of a dry, very fluffy powdered material with an average particle size of 7 nanometers and a surface area of 390+/−40 $m^2/g$. Fumed silica, in an amount equal to the amount of silicone resin, by weight in the solution described in the preceding paragraph, was added to the solution and mixed at room temperature for a period of at least 16 hours in order to fully wet and disperse the fumed silica. A crosslinking/dispersion additive (aminopropyltrimethoxysilane, from Momentive) in an equivalent amount was also added.

The tip of spark plug subassembly to be exposed to the combustion chamber was dip coated in the silicone resin solution as follows:

1. The portion of the insulator requiring the silicone resin treatment was submerged in the diluted silicone resin solution containing inorganic filler
2. After the tip became thoroughly wetted with the mixture, it was drawn upward out of the mixture at a medium rate (~1 second)
3. The wetted tips were then allowed to dry under airflow [face velocity ca. 100 FPM] at room temperature for 1 to 4 hours.
4. The air dried tips were then heated in a convection oven at 120° C. for 1 to 4 hours.
5. The coated tips were then heated in a furnace to a temperature of 350° C. for a period of one hour.
6. The coated subassembly was then used to construct a completed spark plug.

Figure 2:
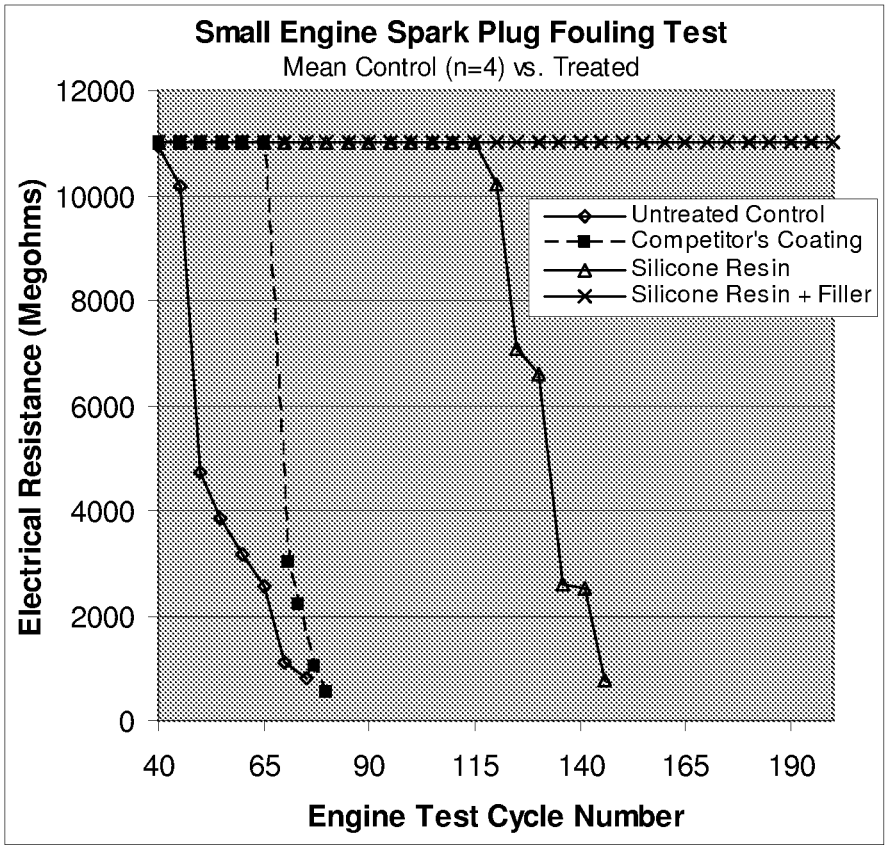
FIG. 2 is a graph showing the result of the small engine spark plug test.

The spark plugs coated with silicone resin and a combination of silicone resin and filler were tested for performance in a small engine (a 5 horsepower engine from a Tecumseh wood chipper). The testing was conducted in open air test area using outdoor ambient conditions (25-90+° F., uncontrolled humidity). The engine was run predominantly fuel rich. The engine ran for 1-5 minutes, and the cooling period between runs was generally 15 minutes. Shunt resistance was measured after every run cycle. Results are shown in FIG. 2.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

All ranges disclosed herein are inclusive of the endpoints, and the endpoints are combinable with each other.

All cited patents, patent applications, and other references are incorporated herein by reference in their entirety.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another.

The invention claimed is:

1. A spark plug comprising an insulative sleeve having a central axial bore and an exterior surface, wherein a coating is disposed on the exterior surface and the coating comprises a silicone resin and an inorganic filler;

a center electrode extending through the central axial bore of the insulative sleeve;

a metal sleeve, wherein the insulating sleeve is positioned within, and secured to, the metal shell; and a ground electrode supported by the metal shell and positioned in a spaced relationship relative to the center electrode so as to generate a spark gap.

2. The spark plug of claim 1, wherein the coating has a thickness of 1 to 20 micrometers.

3. The spark plug of claim 1, wherein the inorganic filler comprises fumed silica.

4. The spark plug of claim 1, wherein the inorganic filler a length to width ratio of greater than 1.

5. A spark plug comprising an insulative sleeve having a central axial bore and an exterior surface, wherein a coating is disposed on the exterior surface and the coating comprises a silicone resin and an inorganic filler in the form of fumed silica;

a center electrode extending through the central axial bore of the insulative sleeve;

a metal sleeve, wherein the insulating sleeve is positioned within, and secured to, the metal shell; and a ground electrode supported by the metal shell and positioned in a spaced relationship relative to the center electrode so as to generate a spark gap.

6. A spark plug comprising an insulative sleeve having a central axial bore and an exterior surface, wherein a coating is disposed on the exterior surface and the coating comprises a silicone resin and an inorganic filler, wherein a ratio of a mass of the inorganic filler to a mass of the silicone resin is at least 1:1;

a center electrode extending through the central axial bore of the insulative sleeve;

a metal sleeve, wherein the insulating sleeve is positioned within, and secured to, the metal shell; and a ground electrode supported by the metal shell and positioned in a spaced relationship relative to the center electrode so as to generate a spark gap.

* * * * *